US006595759B2

(12) United States Patent
Crosta et al.

(10) Patent No.: US 6,595,759 B2
(45) Date of Patent: Jul. 22, 2003

(54) CENTRIFUGAL DEVICE FOR HEATING AND PUMPING FLUIDS

(76) Inventors: Stella Maris Crosta, Pasco 646, (2000) Rosario - Pcia. de Santa Fe (AR); Hector Anibal Plaza, Pasco 646, (2000) Rosario - Pcia. de Santa Fe (AR)

( * ) Notice: Subject to any disclaimer, the term of this patent is extended or adjusted under 35 U.S.C. 154(b) by 30 days.

(21) Appl. No.: 09/918,325

(22) Filed: Jul. 30, 2001

(65) Prior Publication Data

US 2003/0021696 A1 Jan. 30, 2003

(51) Int. Cl.[7] ..... F07B 49/00
(52) U.S. Cl. ..... 417/63; 126/247
(58) Field of Search ..... 417/63, 372, 440; 126/247, 26; 237/12, 3 R, 1 R; 252/69

(56) References Cited

U.S. PATENT DOCUMENTS

| | | | | | |
|---|---|---|---|---|---|
| 3,198,191 | A | | 8/1965 | Wyszomirski | 126/247 |
| 4,143,639 | A | | 3/1979 | Frenette | 126/247 |
| 4,483,277 | A | | 11/1984 | Perkins | 122/26 |
| 4,501,231 | A | | 2/1985 | Perkins | 122/26 |
| 4,779,575 | A | | 10/1988 | Perkins | 122/26 |
| 4,890,988 | A | * | 1/1990 | Kramer et al. | 417/372 |
| 4,915,600 | A | * | 4/1990 | Hutchinson | 417/440 |
| 5,188,090 | A | | 2/1993 | Griggs | 126/247 |
| 5,279,262 | A | * | 1/1994 | Muehleck | 122/26 |
| 5,341,769 | A | | 8/1994 | Ueno et al. | 122/367.3 |
| 5,683,031 | A | * | 11/1997 | Sanger | 237/1 R |
| 5,871,149 | A | * | 2/1999 | Moroi et al. | 237/12.3 R |
| 5,915,341 | A | * | 6/1999 | Moroi et al. | 122/26 |
| 5,970,972 | A | * | 10/1999 | Suzuki et al. | 126/247 |
| 6,047,666 | A | * | 4/2000 | Ban et al. | 122/26 |
| 6,164,274 | A | * | 12/2000 | Giebeler et al. | 126/247 |
| 6,250,561 | B1 | * | 6/2001 | Fujiwara et al. | 237/12.3 R |
| 2002/0056828 | A1 | * | 5/2002 | Hallman | 252/69 |

* cited by examiner

*Primary Examiner*—Teresa Walberg
*Assistant Examiner*—L Fastovsky
(74) *Attorney, Agent, or Firm*—Emrich & Dithmar

(57) ABSTRACT

A centrifugal device for pumping and heating fluids is described. The centrifugal device includes a cylindrical rotor positioned in a cylindrical cavity. The rotor rotates within the cavity and includes bores equally spaced and arranged on the front surface of the rotor according to a predetermined pattern. When a fluid is directed through the device, the fluid is subjected to vortex formation to produce fluid heating.

10 Claims, 3 Drawing Sheets

CENTRIFUGAL DEVICE FOR HEATING AND PUMPING FLUIDS

BACKGROUND OF THE INVENTION

The present invention relates to devices or apparatus which are used to heat fluids and, more particularly, the present invention relates to a centrifugal device for pumping and heating fluids including a cylindrical rotor featuring a number of bores arranged in a certain pattern where fluid is subjected to relative motion thereby producing fluid heating.

The prior art designs of known devices such as stirrers, rotors and scrapers make use of the transfer of kinetic energy to a moving fluid by means of a rotary member. Such devices result in heat generation of a fluid which is due to phenomena, for example:

(1) A water hammer, which is a pressure increase in a pipe, caused by a sudden change in fluid rate or by holding up fluid in the flow;

(2) A shockwave, which refers to a completely developed compressional wave of great amplitude, through which density, pressure and rate of the particles drastically change; or (3) A fluid friction, wherein the fluid flow mechanical energy is converted into calorific energy.

In order to provide heat generation in the fluid, the prior art devices are necessarily mechanically complex devices which require extensive maintenance and servicing due to wear. One example of such a device is U.S. Pat. No. 3,198,191, issued to Wyszormirski, where rotary vanes drive the liquid against cavities in the casing of the housing. The resultant stirring and friction cause the fluid to be heated. In U.S. Pat. No. 4,143,639 issued to Frenette, a rotary rotor and a casing are described, which structure friction heats the lubricant. Also, in U.S. Pat. Nos. 4,483,277 and 4,501,231 issued to Perkins, the same principle of a rotary rotor is used for generating heat by friction. Also, in U.S. Pat. No. 4,779,575 issued to Perkins, rotary rotors are described having fluid inlets in the center thereof with nearly radial bores extending to the surface thereof, wherein the restriction bores produce heating of the fluid by way of friction.

In U.S. Pat. No. 5,341,769 issued to Poppe, a rotary rotor is described having nearly radial bores for causing friction through outlet restrictions. The liquid is driven by a centrifugal force to produce heating of the liquid. Also, in U.S. Pat. No. 5,188,090 issued to Griggs, a rotary cylindrical rotor featuring surface bores produces turbulence within the casing cavity. The bores cause shockwaves and the fluid completes a cavitation process or the formation of bores or cavities in a liquid. Usually, the prior art devices require assistance, which means that the fluid to be processed is required to have a certain inflow pressure. Additionally, such prior art devices generally do not increase the fluid outflow pressure.

In the development of the present invention, between the rotor and the casing there is a typical Taylor-Couette fluid flow created. This flow has been the subject matter of several studies related to the development of normal instability due to turbulence when a fluid rate increases excessively due to an increase in the peripheral speed of the rotor. When the rise in the Reynolds number exceeds a critical value, instability of the fluid occurs.

SUMMARY OF THE INVENTION

It is an object of the present invention to provide conditions and structure for developing fluid internal friction, without exceeding a laminar boundary of the fluid.

It is another object of the present invention to improve upon such prior art devices, which results in a constant rotary movement that creates internal friction and a centrifugal force in the liquid based upon the rotary speed of the device. The higher the rotary speed of the device, the higher the temperature and the centrifugal force. Such conventional treatments have a drawback arising from the fact that when rotary movement is created in a liquid, there is a rate limit that may be reached before the fluid is inevitably exposed to an instability created by vortex formation. As the rotary force increases, the vortexes (unipole, bipole, tripole) finally destabilize the fluid thereby resulting in a limited temperature and a limited fluid pressure.

To overcome the drawbacks of the prior art structures, in the present invention there is a proposed rotor design, which is preferably a flattened, cylindrically shaped rotor featuring front bores with an optional cluster of bores on the cylindrical peripheral wall. The fluid flow is maintained within the laminar boundary before flowing into the instability of the Taylor-Couette flow, which is due to a rise in the fluid rate and a rise in the peripheral speed of the rotor.

The device, in accordance with the present invention, comprises a housing having a fixed casing surrounding an inner cavity. Positioned within the inner cavity is a cylindrical rotary rotor or member structurally arranged to rotate therein. On the rotor's front rotor's face, opposite the fluid inlet, the rotor facing features a number of identical hollows, recesses, irregularities or bores symetrically positioned thereon. It is preferred that five recesses in a regular pentagonal pattern be positioned on the rotor's front face. These recesses may be complemented by a cluster of bores or recesses, preferably three in each cluster on the cylindrical peripheral wall of the rotor.

Accordingly, in accordance with the present invention, the critical value of the Reynolds number is higher than those achieved in prior art devices. Thus, the device of the present invention may be smaller in size than the prior art devices. With the present design, the device achieves higher heating temperatures as well as a higher centrifugal force.

DESCRIPTION OF THE DRAWINGS

The objects of the present invention will be better appreciated when taken in consideration with several drawings, wherein only a preferred embodiment is depicted for illustrative purposes and not limitative in any sense.

In the different views, the same reference numerals apply to the same or similar parts, while letters have been used for designing any arrangement of several elements.

Reference Numerals in the Drawings

Figure 1:
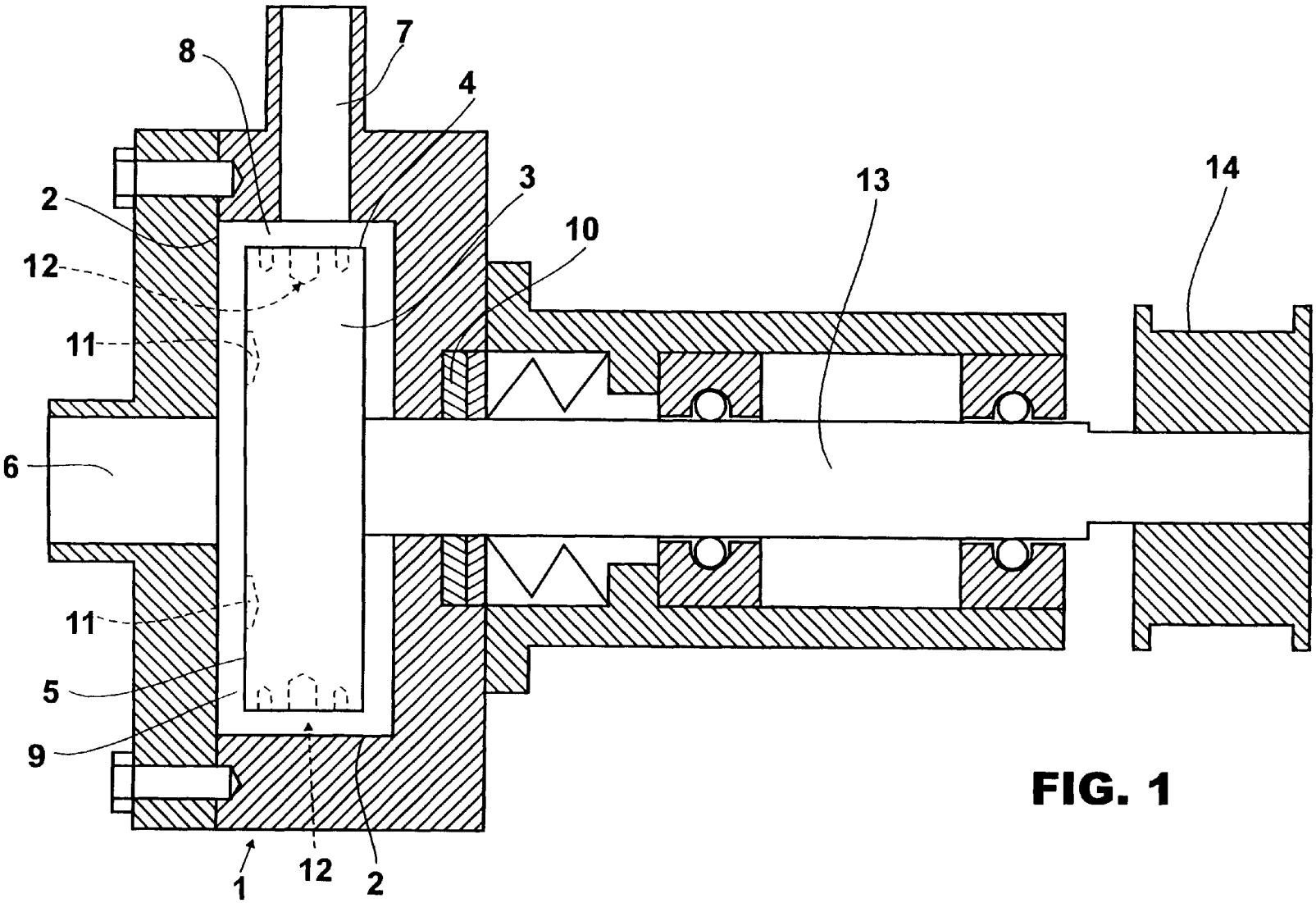
FIG. 1 is a longitudinal section of the device in accordance with the present invention.

(1) Housing formed by the casing of the device

(2) Cylindrical cavity (3) Cylindrical rotor
(4) Cylindrical peripheral wall of rotor (3)
(5) Front base or facing of rotor (3)
(6) Inlet
(7) Outlet
(8) Annular clearance between the rotor (3) and the housing walls (1)
(9) Front clearance between the rotor (3) and the housing walls (1)
(10) Sealing means
(11) Front bores, hollows, recesses or depressions
(12) Second cluster of side bores or recesses (15) (16) on the cylindrical wall (4)
(13) Rotor (3) axis or shaft
(14) Coupling means with rotor (20)
(15) Largest central bore [part of the second cluster (12)]
(16) Smallest central bores [part of the second cluster (12)]
(17) Tilt angle of the second cluster of bores (12)
(18) Alignment axis of the second cluster of bores (12)
(19) Generatrix of the cylindrical wall (4)
(20) Motor
(21) Inlet pipe
(22) Outlet pipe
(23) Inlet valve means
(24) Outlet valve means
(25) Recirculation valve means
(26) Inlet temperature indicator
(27) Inlet pressure indicator
(28) Recirculation pressure indicator
(29) Outlet temperature indicator
(39) Outlet pressure indicator

DETAILED DESCRIPTION

The device provided by the present invention is disclosed in FIG. 1, and comprises a housing 1 formed by a casing having a main body and a lid or cover. This housing 1 defines a cylindrical cavity 2 therein where a fluid inlet 6 leads into the cavity and where a fluid outlet 7 originates from the cavity.

Within the cylindrical cavity 2, there is a cylindrical rotor 3 mounted on a rotary axis or shaft 13. The axis 13 is provided with seal means 10, which prevents fluid leakage from the cylindrical cavity 2. The housing casing is also provided with bearing means and an end having means for coupling the powering motor 20. The powering motor 20 may be an electrical motor, a turbine, an internal combustion motor, a windmill or other powering source. The dimensions of rotor 3 may be about 10 inches in diameter and about 0.5 inches in width or thickness. The size of the annular space 8 about the periphery of the rotor is 0.035 inches (0.9 mm) and the size of the front space or gap 9 on the front facing of the rotor is 0.055 inches (1.4 mm).

Figure 2:
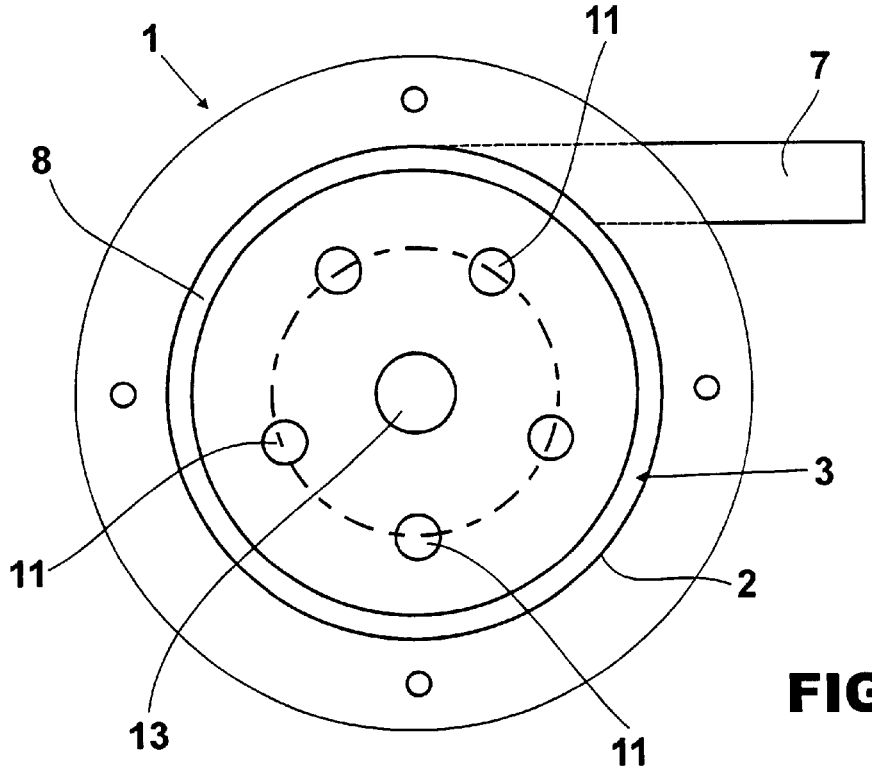
FIG. 2 is a cross-sectional view of the device in accordance with the present invention.
Figure 3:
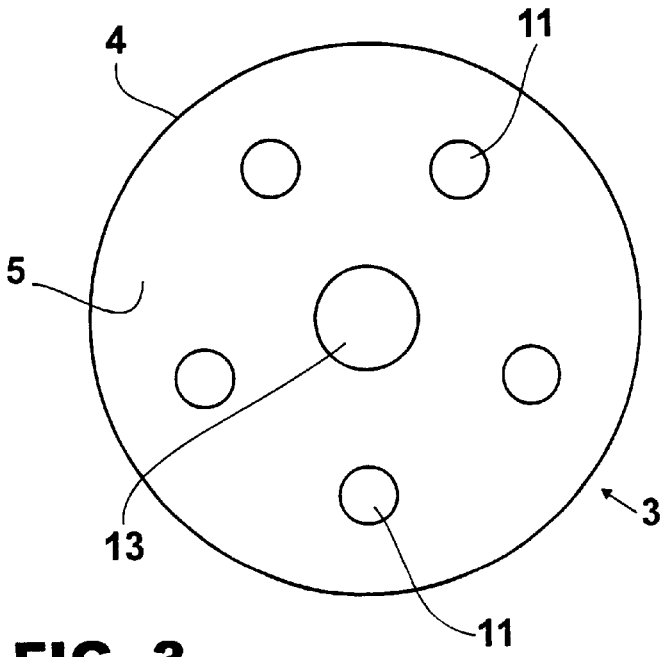
FIG. 3 is a side view of the cylindrical rotor in accordance with the present invention.
Figure 3A:
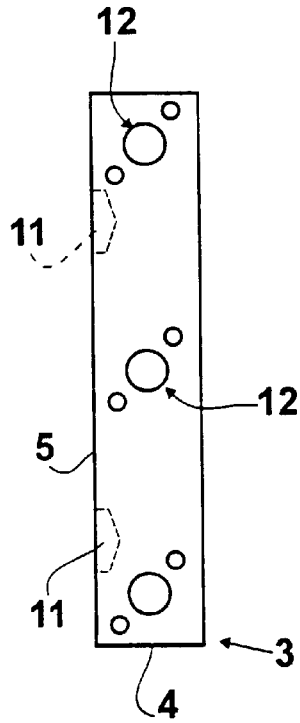
FIG. 3A is an end view of the cylindrical peripheral wall of the rotor in accordance with the present invention.

FIGS. 2, 3 and 3A illustrate a cylindrical rotor 3 being flattened in shape, with a peripheral diameter which is larger than the thickness of the rotor. With respect to the walls of the housing 1, the rotor 3 has a small clearance that will preferably be larger in the front facing clearance 9 than in the annular 8.

As can been seen in FIGS. 1 and 2, fluid inlet 6 leads into the front base or facing 5 of rotor 3, while the outlet 7 tangentially projects outwards from the housing 1.

In FIG. 3, the front base 5 of the cylindrical rotor 3 shows a cluster of front recesses, hollows, bores or depressions 11 circumferentially aligned between the periphery and the axis 13 of said cylindrical rotor 3. The recesses are regularly or equally spaced between each other about the facing to provide a balanced rotor. Preferably, there are five front bores 11 mating the vertexes of a pentagon; with the axis of the cylindrical rotor 3 passing through the center of the pentagon. The diameter of the alignment circumference of front bores 11 is determined by the chosen rotor diameter 3. The diameter of the bores 11 may vary between 1 and 2 inches and the depth of the bores is always a fraction of the diameter of the bores. This configuration mates a proper dynamic accompaniment of the vortexes or geometric shapes formed by the fluid flow within the cylindrical cavity 2 and provides a balanced rotor within the casing.

Figure 4:
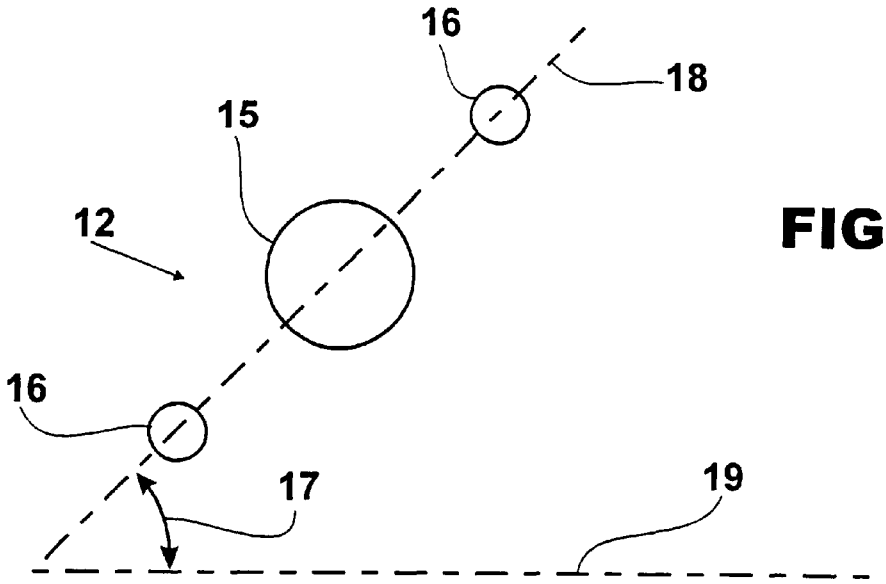
FIG. 4 shows a cluster of bores as those on the cylindrical peripheral wall of the rotor in accordance with the present invention.

The inclusion of a second cluster 12 of bores or recesses 15 and 16 regularly arranged along the cylindrical peripheral wall 4 of the rotor 3, as is shown in FIGS. 3 and 3A, increase the heating capacity of the device. Each second cluster of bores 12 comprises a central bore 15 and two lateral bores 16 which diameter is less than the diameter of the central bore 15. Also the three bores 15 and 16 are aligned on a tilted virtual axis 18 at an angle less than 90° to the generatrix 19 of the cylindrical rotor 3, as shown in FIG. 4.

Figure 5:
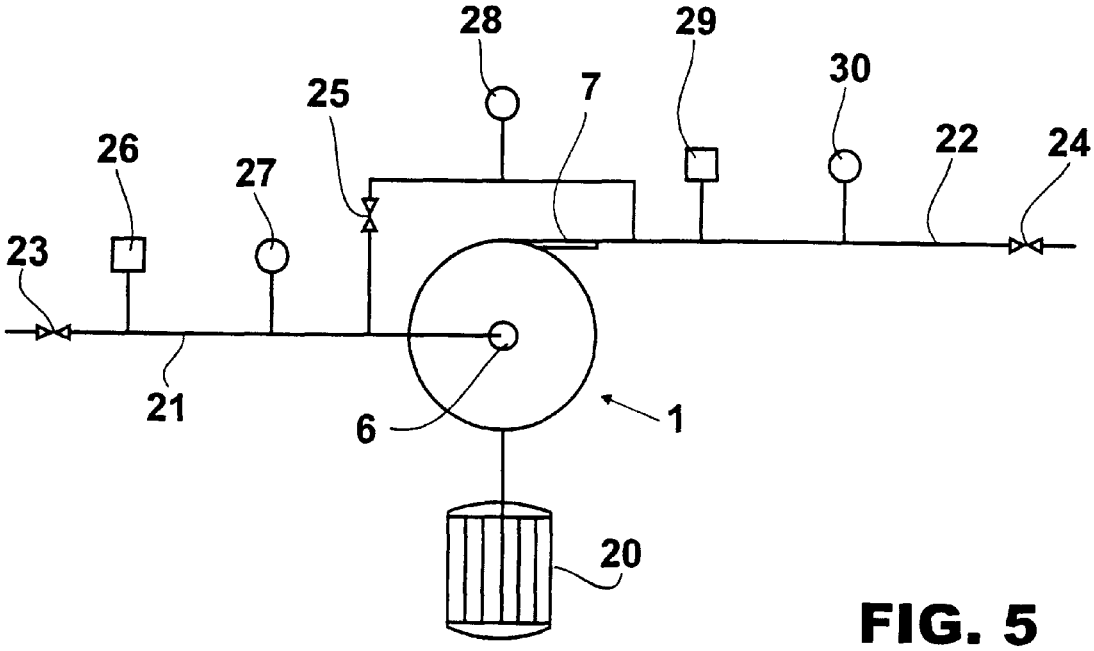
FIG. 5 is a schematic diagram of the device in accordance with the present invention.

In the preferred embodiment, the pumping and heating device may be integral to a system, as the one shown in the diagram of FIG. 5.

The operation is required to start with the full ejection of air from the device. As the motor 20 is started, the outlet valve 24 is opened. Immediately, the inlet valve 23 is regulated for setting the recirculation pressure as denoted by the recirculation pressure indicator or member 28. If necessary, the recirculation valve 25 may be regulated so as to achieve the desired discharge pressure, as indicated by the outlet pressure indicator or member 30. The desired temperature is achieved by regulating the outlet valve 24 which is shown by the outlet temperature indicator or member 29. The inlet temperature indicator 26 shows the temperature of the fluid inflow into the system. The operation may be easily automated with pressure and temperature controllers, if desired.

When the present invention is practiced, several modifications may be made relative to constructive and design details, always within the scope of the appended claims.

We claim:

1. A centrifugal device for pumping and heating a fluid is powered by a motor, the device having an inlet with a tangential connection to a fluid feeding tube and an outlet connected to an exhausting tube for the heated fluid, including in combination;

a closed housing sealed by sealing means which form a cylindrical cavity within the housing which communicates with a fluid inlet and in the periphery of said cavity thereof which communicates with a fluid outlet;

a cylindrical rotor is positioned in said cylindrical cavity and mounted on a centerline axis in said cavity to rotate within said cavity, with said rotor including a front facing and a cylindrical peripheral wall facing having surface bores thereon, with said rotor being powered by the motor;

a plurality of recesses circumferentially arranged between the periphery and the axis of said front facing of said cylindrical rotor, with said recesses equally spaced between each other on said front facing; and wherein between the facing walls of said housing cavity and said rotor there is a reduced clearance which permits said recesses to take effect upon the vortexes of the fluid flow to increase friction with the fluid to thereby increase the temperature of the fluid.

2. The centrifugal device in accordance with claim 1, wherein said inlet and said outlet are provided with valve members, pressure members for indicating the pressure of the fluid and temperature members for indicating the temperature of the fluid.

3. The centrifugal device in accordance with claim 1, wherein the device includes a recirculating pipe provided with a valve member and a recirculating pressure indicator member between the inlet connection and the outlet connection.

4. The centrifugal device in accordance with claim 1, wherein said cylindrical rotor is structurally arranged to have a diameter which is greater than its thickness.

5. The centrifugal device in accordance with claim 1, wherein the recesses are bores within the front facing of said cylindrical rotor.

6. The centrifugal device in accordance with claim 1, wherein said plurality of recesses are five surface bores matching the vertexes of a pentagon, with said centerline axis of said cylindrical rotor passing through the center of said pentagon.

7. The centrifugal device in accordance with claim 1, wherein said surface bores on said cylindrical peripheral wall form three-bore clusters, with said clusters being equally spaced about said cylindrical peripheral wall facing.

8. The centrifugal device in accordance with claim 1, wherein said surface bores on the cylindrical peripheral wall facing form clusters regularly spaced along said cylindrical wall, wherein each cluster is formed by a central bore and two lateral bores, with said lateral bores being narrower in diameter than said central bore.

9. The centrifugal device in accordance with claim 8, wherein said bores of each of said clusters on the cylindrical peripheral wall facing are aligned on a virtual axis tilted to the generatrix of said cylindrical rotor.

10. The centrifugal device in accordance with claim 1, wherein the clearance between said cylindrical rotor and the walls of said cylindrical housing comprises an annular peripheral portion and a frontal portion, with said clearance being greater in said frontal position than said annular peripheral portion of said cylindrical rotor.

* * * * *